US010823202B2

(12) United States Patent
Guo et al.

(10) Patent No.: US 10,823,202 B2
(45) Date of Patent: Nov. 3, 2020

(54) MUFFLING DEVICE AND VENTILATING FAN HAVING THE SAME

(71) Applicant: Johnson Electric International AG, Murten (CH)

(72) Inventors: Chuanjiang Guo, Shenzhen (CN); Chuanhui Fang, Hong Kong (CN); Mingju Chen, Shenzhen (CN); Chikuen Au, Hong Kong (CN)

(73) Assignee: JOHNSON ELECTRIC INTERNATIONAL AG, Murten (CH)

( * ) Notice: Subject to any disclaimer, the term of this patent is extended or adjusted under 35 U.S.C. 154(b) by 69 days.

(21) Appl. No.: 16/373,348

(22) Filed: Apr. 2, 2019

(65) Prior Publication Data

US 2019/0301491 A1 Oct. 3, 2019

(30) Foreign Application Priority Data

Apr. 3, 2018 (CN) ..... 2018 1 0294017

(51) Int. Cl.
*F04D 29/42* (2006.01)
*F04D 29/66* (2006.01)
*F04D 17/16* (2006.01)

(52) U.S. Cl.
CPC ..... *F04D 29/664* (2013.01); *F04D 17/16* (2013.01); *F05B 2240/14* (2013.01); *F05B 2260/96* (2013.01)

(58) Field of Classification Search
CPC .... F04D 29/664; F04D 17/16; F04D 29/4213; F04D 29/4426; F04D 29/663; F04D 25/08; F04D 29/16; F04D 29/083; F05B 2240/14; F05B 2260/96; F05D 2250/51
See application file for complete search history.

(56) References Cited

U.S. PATENT DOCUMENTS

| | | | | |
|---|---|---|---|---|
| 8,231,334 | B2 * | 7/2012 | Lind | F04D 29/441 415/119 |
| 9,915,273 | B2 * | 3/2018 | Katsumata | F04D 29/665 |
| 10,473,116 | B2 * | 11/2019 | Stevens | F04D 29/526 |
| 2016/0025109 | A1 * | 1/2016 | Katsumata | F04D 29/281 415/119 |
| 2018/0245602 | A1 * | 8/2018 | Stevens | F04D 29/164 |

* cited by examiner

*Primary Examiner* — Eldon T Brockman
(74) *Attorney, Agent, or Firm* — Millman IP Inc.

(57) ABSTRACT

A muffling device applied to a ventilating fan having a scroll casing that has a bottom plate and a top plate includes a first annular muffling panel and a second annular muffling panel. The first muffling panel includes a first wall extending from an edge of the through hole in a direction away from the bottom plate and a second wall extending inward from a top end of the first wall and extending toward the bottom plate. The second muffling panel includes a third wall extending from the top plate in a direction away from the bottom plate and a fourth wall extending from a top end of the third wall. The first muffling panel, the second muffling panel, and the top plate corporately define a first noise reduction chamber. A distance from the second muffling panel to the first muffling panel is gradually increased in a radially outward direction.

12 Claims, 6 Drawing Sheets

MUFFLING DEVICE AND VENTILATING FAN HAVING THE SAME

CROSS REFERENCE TO RELATED APPLICATIONS

This non-provisional patent application claims priority under 35 U.S.C. § 119(a) from Patent Application No. 201810294017.0 filed in the People's Republic of China on Apr. 3, 2018.

FIELD

The present disclosure relates to ventilating fans, and particularly to a muffling device and a ventilating fan having the muffling device.

BACKGROUND

A muffler of a ventilating fan is generally a panel with a through hole that is arranged on a suction port of a scroll casing of the ventilating fan. The noise generated by the suction port is sucked by the panel and can repeatedly collide with the inner wall of the chamber of the panel, thereby reducing noise. However, since the chamber of the panel is usually short, and there is still a problem of relatively loud noise.

SUMMARY

A muffling device applied to a ventilating fan having a scroll casing that has a bottom plate and a top plate includes a first annular muffling panel and a second annular muffling panel. The first muffling panel includes a first wall extending from an edge of the through hole in a direction away from the bottom plate and a second wall extending inward from a top end of the first wall and extending toward the bottom plate. The second muffling panel includes a third wall extending from the top plate in a direction away from the bottom plate and a fourth wall extending from a top end of the third wall. The first muffling panel, the second muffling panel, and the top plate corporately define a first noise reduction chamber. A distance from the second muffling panel to the first muffling panel is gradually increased in a radially outward direction.

DETAILED DESCRIPTION

Embodiments of the present disclosure will be described in detail in conjunction with the drawings. It should be noted that the figures are illustrative rather than limiting. The figures are not drawn to scale, do not illustrate every aspect of the described embodiments, and do not limit the scope of the present disclosure.

Figure 1:
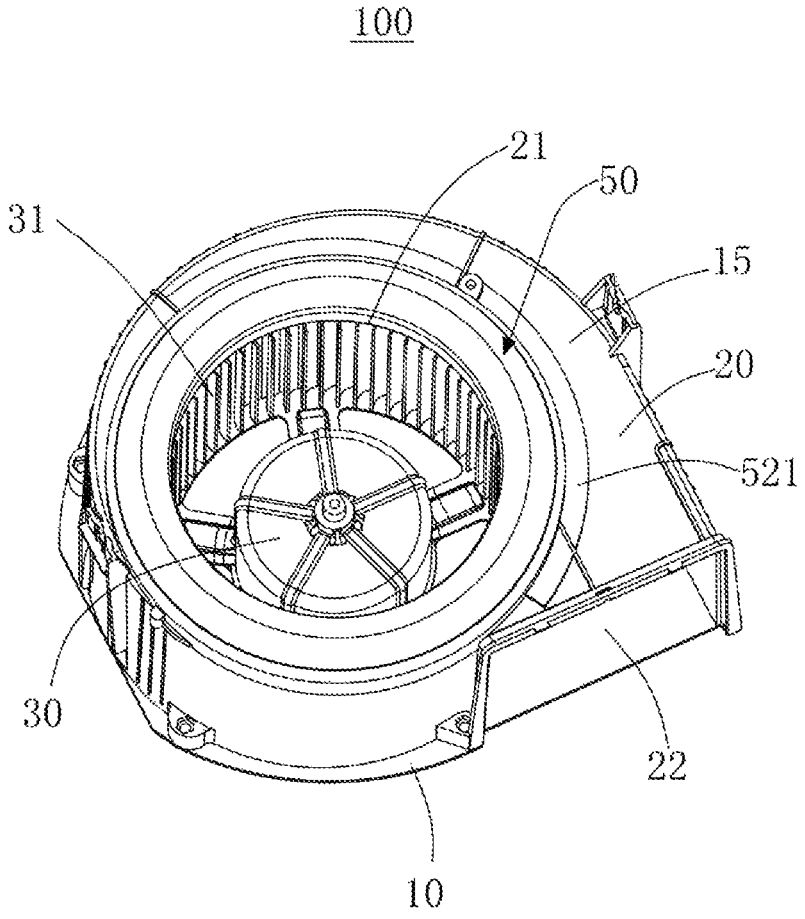
FIG. 1 is an isometric view of a ventilating fan according to an embodiment.

Referring to FIG. 1, in one embodiment, a ventilating fan 100 includes a scroll casing 20 having an bottom plate 10 and a top plate 15, a motor 30 arranged within the scroll casing 20, an impeller 31 connected to the output shaft of the motor 30, and a muffling device 50 arranged on the top plate 15. The scroll casing 20 is preferably made of a resin material. The top plate 15 defines a through hole 17 (see FIGS. 3 and 4). The muffling device 50 extends circumferentially along the edge of the through hole 17. The muffling device 50 is substantially annular and defines an inner through hole 21 that serves as an inlet allowing air to flow thereinto.

The scroll casing 20 has a conventional configuration and has a passage extending spirally in the circumferential direction. An air outlet 22 of the passage is defined in a sidewall of the scroll casing 20. The impeller 31 is driven by the motor 30. The impeller 31 is a centrifugal impeller which is arranged in the passage of the scroll casing 20. One end of the impeller 31 in the axial direction faces the air inlet 21. In one embodiment, the muffling device 50, the through hole 17 (see FIG. 4), and the impeller 31 are coaxial.

Figure 2:
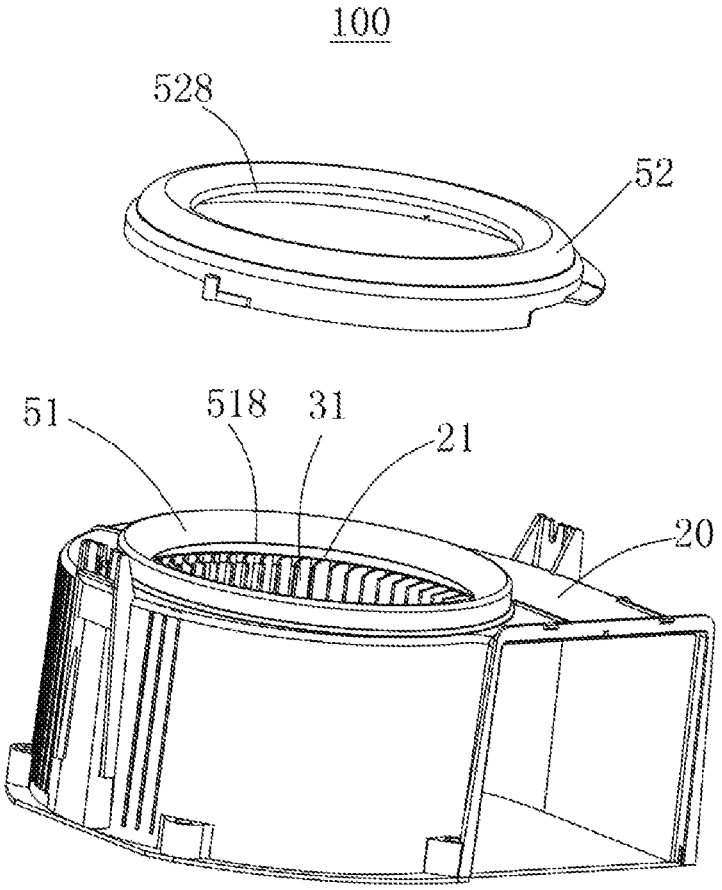
FIG. 2 is an isometric exploded view of the ventilating fan of FIG. 1.
Figure 3:
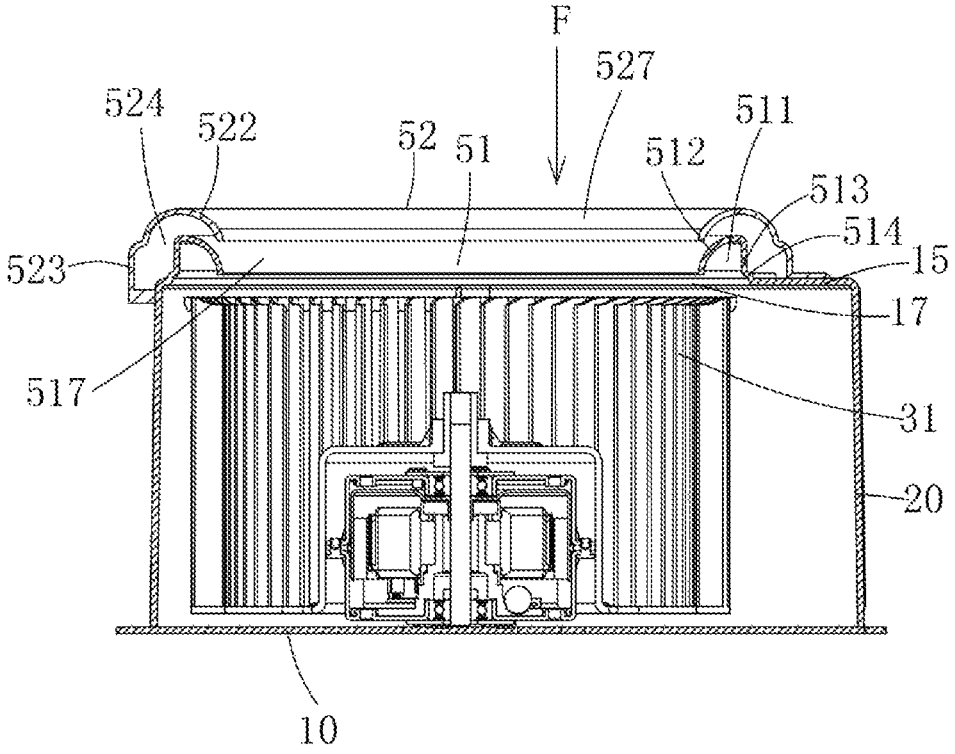
FIG. 3 is an cross-sectional view of the ventilating fan of FIG. 1.
Figure 4:
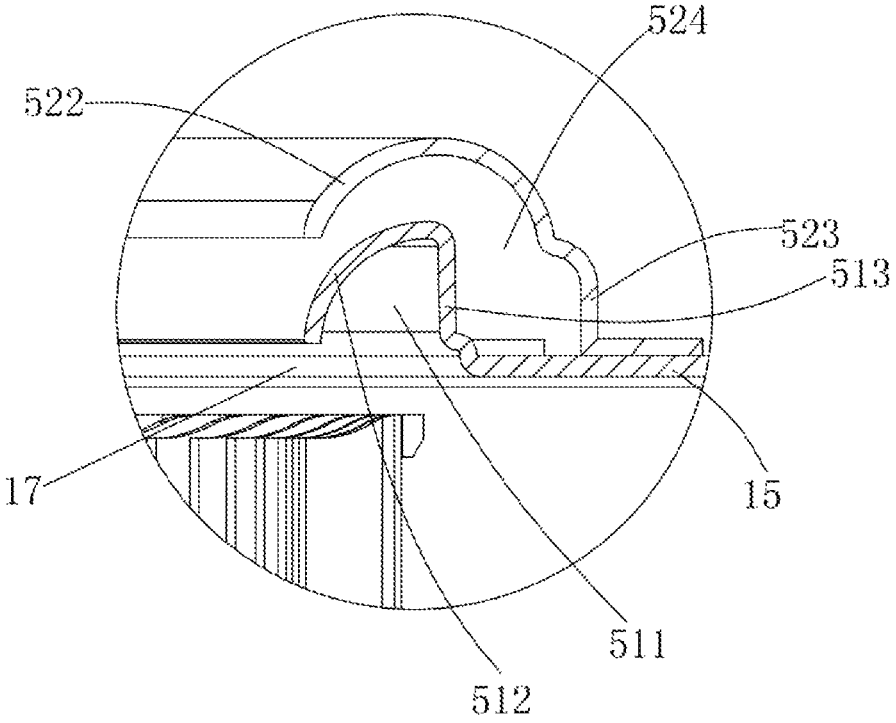
FIG. 4 is an enlarged view of a first portion of FIG. 3.

Referring to FIGS. 2-4, the muffling device 50 includes a first annular muffling panel 51 arranged on the top plate 15 of the scroll casing 20 and a second annular muffling panel 52 located on a side of the first muffling panel 51 away from the bottom plate 10 of the scroll casing 20. The second muffling panel 52 substantially covers the first muffling panel 51. The first muffling panel 51 and the second muffling panel 52 are preferably made of a resin material.

The first muffling panel 51 includes a first wall 513 extending from the edge of the through hole 17 of the top plate 15 in a direction away from the bottom plate 10, and a second wall 512 extending radially inward from a top end of the first wall 513 and extending toward the bottom plate 10. The second muffling panel 52 includes a third wall 523 extending from the top plate 15 in a direction away from the bottom plate 10, and a fourth wall 522 extending from the top end of the third wall 523. The cross section of the second wall 512 (see FIG. 3) is a curved line segment that rotates about an imaginary axis to form the second annular wall 512 in the shape of a bell mouth. The third wall 523 surrounds the first wall 513, which are spaced apart from and substantially parallel to each other. The cross section of the fourth wall 522 (see FIG. 3) is a curved line segment close to a semicircular shape. That is, it extends from the top end of the third wall 523 a distance away from the bottom plate 10, and then then extends a distance toward the bottom plate 10. A first noise reduction chamber 524 is formed between the third wall 523, the fourth wall 522, the first muffling panel 51, and the top plate 15. A second noise reduction chamber 511 is formed between the first wall 513 and the second wall 512.

The inner edge of the second annular wall 512 defines a first hole 518. The inner edge of the fourth wall 522 defines a second hole 528. The first hole 518 is closer to the bottom plate 10 than the second hole 528. In the embodiment, the diameter of the first hole 518 is the same as the diameter of the second hole 528.

The bottom end of the first ring wall 513 is connected to the edge of the through hole 17 of the top plate 15 through a first connecting portion 514 (see FIG. 1). The first connecting portion 514 is curved. In the embodiment, the first muffling panel 51 is integrally formed with the top plate 15 of the scroll casing 20, that is, the first wall 513 protrudes from the edge of the through hole 17 of the top plate 15.

In this embodiment, the inner edge of the second wall 512 is slightly higher in the axial direction than the edge of the through hole 17, so that noise is conveniently transmitted to the second noise reduction chamber 511 to increase the noise reduction effect. In an alternative embodiment, the inner edge of the second wall 512 may be in the same plane as the bottom end of the first wall 513, and the plane is parallel to the bottom plate 10. Thus, the area where the noise entering the second noise reduction chamber 511 collides is increased, which increases the noise reduction effect.

In the embodiment, the first wall 513 is cylindrical and extend upward from the first connecting portion 514 in the axial direction. The first wall 513 is substantially perpendicular to the top plate 15 of the scroll casing 20. The second wall 512 has a smooth first air guiding surface 517, and the angle between the first air guiding surface 517 and the airflow direction F (substantially parallel to axial direction) gradually decreases.

Similarly, the fourth wall 522 has a smooth second air guiding surface 527, and the angle between the second air guiding surface 527 and the airflow direction F gradually decreases.

Since the second hole 528 and the first hole 518 have the same diameter and the edges of the two holes are vertically spaced from each other in the airflow direction F, air sucked by the ventilating fan 100 is first guided by the second air guiding surface 527 and then guided by the first air guiding surface 517. The second air guiding surface 527 and the first air guiding surface 517 are smooth, which facilitates smooth flowing of the air sucked by the ventilating fan 100 and reduction of air turbulence, thereby reducing the noise caused by the airflow.

The second muffling panel 52 is an independent component. The third wall 523 is mounted to the top plate 15 of the scroll casing 20. Specifically, the wall 523 has an outwardly extending flange as a mounting portion 521 (see FIG. 1), and the second muffling panel 52 is fixed to the top plate 15 of the scroll casing 20 by the mounting portion 521.

Figure 5:
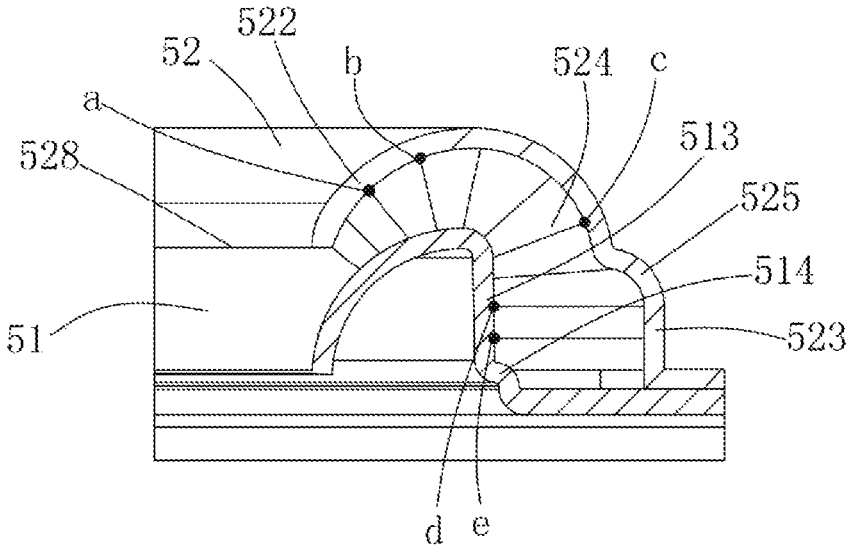
FIG. 5 is an enlarged view of a second portion of FIG. 3.

Referring to FIG. 5, the first noise reduction chamber 524 is located between the first muffling panel 51 and the second muffling panel 52. A distance from the second muffling panel 52 to the first muffling panel 51 is gradually increased in a radially outward direction. That is, the distance between the first muffling panel 51 and the second muffling panel 52 gradually increases in the direction from the edge of the second hole 528 toward the outer circumferential surface of the second muffling panel 52. More specifically, the distance between fourth wall 522 and the first muffling panel 51 gradually increases in a radially outward direction. For example, the distance from a position "b" on the fourth wall 522 to the second wall 512 is greater than the distance from a position "a" on the fourth wall 522 to the second wall 512. The distance from the position "c" located outside the position "b" to the first wall 513 is greater than the distance from the position "b" to the second wall 512. The distance between the first wall 513 and the third wall 523 remains constant and greater than the distance between the second wall 512 and the fourth wall 522. For example, the distances from the positions "d" and "e" on the first wall 513 to the third wall 523 are equal, and are greater than the distances from the positions "a" and "b" on the fourth wall 522 to the second wall 512. Thus, the noise is absorbed by the gradually expanding first noise reduction chamber 524 during the process of entering the first noise reduction chamber 524, further improving the noise reduction effect.

In one embodiment, the third wall 523 and the fourth wall 522 are connected to each other by a curved connecting portion 525.

When the motor 30 is in operation, a portion of the noise generated by the motor 30 and/or the airflow enters the second noise reduction chamber 511 and repeatedly impinge on the first wall 513 and the second wall 512 of the second noise reduction chamber 511. During this process, the energy of the noise is gradually weakened, thereby reducing noise. Another portion of the noise enters the first noise reduction chamber 524, and is gradually diffused by the gradually increasing first noise reduction chamber 524 during the process of entering, so that the energy is gradually weakened, thereby achieving noise reduction. With this configuration, the noise generated by the motor 30 can be minimized, and the efficiency of noise reduction is greatly improved.

Figure 6:
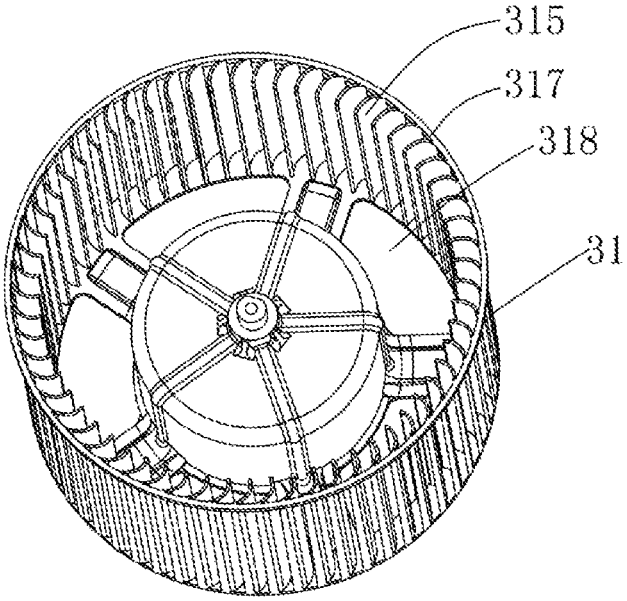
FIG. 6 is an isometric view of an impeller of the ventilating fan of FIG. 1.

Referring to FIG. 6, in one embodiment, the centrifugal impeller 31 includes a number of axially extending vanes 315, one end of each of which is fixed to an annular body 317. The ends of the vanes 315 corporately form a chamber 318. Preferably, the inner diameter of the chamber 318 is equal to the inner diameter of the first hole 518 of the first muffling panel 51 and is also equal to the inner diameter of the second hole 528 of the second muffling panel 52.

The invention claimed is:

1. A muffling device applied to a ventilating fan having a scroll casing that comprises a bottom plate and a top plate, the top plate defining a through hole, the muffling device comprising:

a first annular muffling panel arranged on the top plate and a second annular muffling panel located on a side of the first muffling panel away from the bottom plate;

wherein the first muffling panel comprises a first wall extending from an edge of the through hole in a direction away from the bottom plate, and a second wall extending inward from a top end of the first wall and extending toward the bottom plate, the second muffling panel comprises a third wall extending from the top plate in a direction away from the bottom plate, and a fourth wall extending from a top end of the third wall, the first muffling panel, the second muffling panel, and the top plate corporately define a first noise reduction chamber, a distance from the second muffling panel to the first muffling panel is gradually increased in a radially outward direction.

2. The muffling device according to claim 1, wherein the first wall and the second wall corporately define a second noise reduction chamber.

3. The muffling device according to claim 1, wherein a bottom end of the first wall is connected to the edge of the through hole through a first connecting portion.

4. The muffling device according to claim 3, wherein an inner edge of the second wall and a bottom end of the first wall are coplanar or higher in an axial direction than the bottom end of the first wall.

5. The muffling device according to claim 1, wherein a distance between the first wall and the third wall is greater than a distance between the second wall and the fourth wall.

6. The muffling device according to claim 5, wherein the distance from the second wall to the fourth wall gradually increases in a radially outward direction, and the distance between the first wall and the third wall remains constant.

7. A ventilating fan comprising:

a scroll casing comprising a bottom plate and a top plate, the top plate defining a through hole;

a motor arranged within the scroll casing;

an impeller connected to the motor; and a muffling device comprising a first annular muffling panel arranged on the top plate and a second annular muffling panel located on a side of the first muffling panel away from the bottom plate;

wherein the first muffling panel comprises a first wall extending from an edge of the through hole in a direction away from the bottom plate and a second wall extending inward from a top end of the first wall and extending toward the bottom plate, the second muffling panel comprises a third wall extending from the top plate in a direction away from the bottom plate and a fourth wall extending from a top end of the third, the first muffling panel, the second muffling panel, and the top plate corporately define a first noise reduction chamber, a distance from the second muffling panel to the first muffling panel is gradually increased in a radially outward direction.

8. The ventilating fan according to claim 7, wherein the first wall and the second wall corporately define a second noise reduction chamber.

9. The ventilating fan according to claim 7, wherein a bottom end of the first wall is connected to the edge of the through hole through a first connecting portion.

10. The ventilating fan according to claim 9, wherein an inner edge of the second wall and a bottom end of the first wall are coplanar or higher in an axial direction than the bottom end of the first wall.

11. The ventilating fan according to claim 7, wherein a distance between the first wall and the third wall is greater than a distance between the second wall and the fourth wall.

12. The ventilating fan according to claim 11, wherein the distance from the second wall to the fourth wall gradually increases in a radially outward direction, and the distance between the first wall and the third wall remains constant.

* * * * *